US010655908B2

(12) United States Patent
Qi et al.

(10) Patent No.: US 10,655,908 B2
(45) Date of Patent: May 19, 2020

(54) REFRIGERATOR CONTROLLING METHOD AND SYSTEM WITH LINEAR COMPRESSOR

(71) Applicant: QINGDAO HAIER JOINT STOCK CO., LTD., Qingdao, Shandong Province (CN)

(72) Inventors: Feifei Qi, Qingdao (CN); Xiaobing Zhu, Qingdao (CN); Jianru Liu, Qingdao (CN); Lisheng Ji, Qingdao (CN); Shufeng Zhang, Qingdao (CN)

(73) Assignee: QINGDAO HAIER JOINT STOCK CO., LTD., Qingdao, Shandong Province (CN)

( * ) Notice: Subject to any disclaimer, the term of this patent is extended or adjusted under 35 U.S.C. 154(b) by 230 days.

(21) Appl. No.: 15/547,054

(22) PCT Filed: Aug. 15, 2016

(86) PCT No.: PCT/CN2016/095268
§ 371 (c)(1),
(2) Date: Jul. 27, 2017

(87) PCT Pub. No.: WO2017/076098
PCT Pub. Date: May 11, 2017

(65) Prior Publication Data

US 2018/0010847 A1 Jan. 11, 2018

(30) Foreign Application Priority Data

Nov. 5, 2015 (CN) ..... 2015 1 0746662

(51) Int. Cl.
*F25B 1/02* (2006.01)
*F25D 29/00* (2006.01)
(Continued)

(52) U.S. Cl.
CPC ..... *F25D 29/005* (2013.01); *F04B 35/04* (2013.01); *F04B 35/045* (2013.01);
(Continued)

(58) Field of Classification Search
CPC ..... F25B 2400/073; F25B 2500/31; F25B 2600/025; F25D 2700/14
See application file for complete search history.

(56) References Cited

U.S. PATENT DOCUMENTS

2005/0028541 A1* 2/2005 Maier ..... F25D 11/022 62/178
2010/0179693 A1* 7/2010 Sung ..... F25B 49/025 700/275
2013/0055730 A1* 3/2013 Fragnito ..... F25D 29/003 62/56

FOREIGN PATENT DOCUMENTS

CN 1156814 A 8/1997
CN 101050907 A 10/2007
(Continued)

OTHER PUBLICATIONS

Machine translation of CN 1156814 to LG.*
Machine translation of CN 101050907 to Matsushita.*

*Primary Examiner* — Filip Zec
(74) *Attorney, Agent, or Firm* — Cheng-Ju Chiang

(57) ABSTRACT

The present invention discloses a refrigerator controlling method and system with a linear compressor. The method comprises: monitoring an environment temperature T of the refrigerator located in the environment comparing the environment temperature T with a preset environment temperature threshold T0; if T is larger than T0, controlling a refrigerating unit and/or a heating unit in the refrigerator such that the refrigerator runs under a first operation condition; and if T is smaller than or equal to T0, controlling the refrigerating unit and/or the heating unit in the refrigerator
(Continued)

such that the refrigerator runs under a second operation condition. When the linear compressor runs within predetermined time, a refrigeration amount of the linear compressor under the second operation condition is controlled to be larger than a refrigeration amount of the linear compressor under the first operation condition, such that a compartment of the refrigerator reaches a target temperature.

17 Claims, 10 Drawing Sheets

(51) Int. Cl.

| | |
|---|---|
| ***F04B 35/04*** | (2006.01) |
| ***F04B 51/00*** | (2006.01) |
| ***F04B 49/06*** | (2006.01) |
| ***F25B 49/00*** | (2006.01) |
| ***F25B 49/02*** | (2006.01) |

(52) U.S. Cl.
CPC ..... *F04B 49/065* (2013.01); *F04B 51/00* (2013.01); *F25B 1/02* (2013.01); *F25B 49/005* (2013.01); *F25B 49/022* (2013.01); *F04B 2207/03* (2013.01); *F25B 2400/073* (2013.01); *F25B 2500/31* (2013.01); *F25B 2600/025* (2013.01); *F25B 2600/11* (2013.01); *F25D 2400/34* (2013.01); *F25D 2700/14* (2013.01)

(56) References Cited

FOREIGN PATENT DOCUMENTS

| | | | |
|---|---|---|---|
| CN | 203394701 | U | 1/2014 |
| CN | 105241171 | A | 1/2016 |
| CN | 105241172 | A | 1/2016 |
| CN | 105241174 | A | 1/2016 |
| CN | 105258446 | A | 1/2016 |
| CN | 105258447 | A | 1/2016 |
| WO | 2006/124004 | A1 | 11/2006 |

* cited by examiner

T

REFRIGERATOR CONTROLLING METHOD AND SYSTEM WITH LINEAR COMPRESSOR

CROSS REFERENCE TO RELATED APPLICATIONS

The present application is a 35 U.S.C. § 371 National Phase conversion of International (PCT) Patent Application No. PCT/CN2016/095268, filed on Aug. 15, 2016, which claims benefit of Chinese patent application No. 201510746662.8, filed on Nov. 5, 2015, the disclosure of which is incorporated by reference herein. The PCT International Patent Application was filed and published in Chinese.

TECHNICAL FIELD

The present invention is related to the technical field of a refrigerator and a linear compressor, and more particularly, to a refrigerator controlling method and system with a linear compressor.

BACKGROUND

A compressor is a driven fluid machinery for promoting a low-pressure gas to a high-pressure gas and serves as the heart of a refrigeration system. It takes from an air intake tube a low-temperature and low-pressure refrigerant gas, forces down the piston to compress the gas under the drive of a motor, and then emits a high-temperature and high-pressure refrigerant gas to an air exhaust tube so as to supply a driving force to a refrigeration cycle. As such, a refrigeration cycle of compression→condensation (heat release) →expansion→evaporation (heat absorption) is realized.

A linear compressor is widely used in a device with a small refrigeration amount such as a refrigerator. It has advantages of a simple structure, less friction loss, low noise, convenient flow regulation through voltage regulation, more simple and reliable embodiment than frequency conversion regulation, and less use or no use of oil or lubricating oil, etc. A Chinese patent CN203394701U discloses a linear compressor. As shown in FIG. 1, it comprises two parts: a gas exhaust mechanism 1 and a compressor unit. The compressor unit comprises: a cylinder 16, a piston unit, a movable magnet linear oscillation motor, a resonant spring 8 and a compressor casing. The piston unit comprises: a piston 2, a piston rod 3, a rod end plate 10 and a suction valve 15. The gas exhaust mechanism 1 comprises an exhaust valve slice 17, an exhaust valve plate 18, etc.

A linear compressor is under electronic control during its running. When the output power is small, the stroke of the piston 2 in the linear compressor is relatively small. Thus, the piston 2 and the exhaust valve plate 18 can easily collide with each other, causing the compressor to fail. In light of this, when designing a frequency conversion plate of a linear compressor, people will set up a protection program to prevent damage to the mechanical components of the compressor. For example, the frequency conversion plate of the linear compressor will launch the protection program to stop the linear compressor from running.

When a refrigerator is running at a low temperature, the heat load of the refrigerator is relatively low, and accordingly, the refrigeration amount required by compartments is relatively low. In this case, the linear compressor will run with a lower output power, causing a small piston stroke in the linear compressor. As a result, a hidden danger of colliding with the exhaust valve plate by the piston exists.

SUMMARY

This invention aims to overcome the defect in the prior art and provide a refrigerator controlling method and system with a linear compressor.

In order to solve the above-mentioned problems, the technical solutions of this invention are provided as follows.

This invention provides a refrigerator controlling method with a linear compressor. The method comprises: monitoring an environment temperature T of the refrigerator located in the environment; comparing the environment temperature T with a preset environment temperature threshold T0; if T is larger than T0, controlling a refrigerating unit and/or a heating unit in the refrigerator such that the refrigerator runs under a first operation condition; and if T is smaller than or equal to T0, controlling the refrigerating unit and/or the heating unit in the refrigerator such that the refrigerator runs under a second operation condition, wherein, when the linear compressor runs within predetermined time, controlling refrigeration amount of the linear compressor under the second operation condition to be larger than refrigeration amount of the linear compressor under the first operation condition, such that a compartment of the refrigerator reaches a target temperature.

As a further improvement of this invention, controlling the refrigeration amount of the linear compressor under the second operation condition to be larger than the refrigeration amount of the linear compressor under the first operation condition comprises: in a case where a refrigerator load does not vary, controlling refrigeration amount required by a freezing compartment of the refrigerator under the second operation condition to be larger than refrigeration amount required by the freezing compartment of the refrigerator under the first operation condition.

As a further improvement of this invention, the method further comprises: monitoring an operation status of the linear compressor; when the operation status of the linear compressor becomes abnormal, changing the operation condition of the refrigerator so as to increase the refrigeration amount required by the freezing compartment of the refrigerator when the linear compressor runs within the predetermined time; and after the operation status of the linear compressor becomes normal, setting a current operation condition of the refrigerator as the second operation condition.

As a further improvement of this invention, the method comprises: monitoring an operation status of the linear compressor; when the operation status of the linear compressor becomes abnormal, changing the operation condition of the refrigerator so as to increase the refrigeration amount required by the freezing compartment of the refrigerator when the linear compressor runs within the predetermined time; and after the operation status of the linear compressor becomes normal, setting a current operation condition of the refrigerator as a third operation condition, associating the third operation condition with the environment temperature T, and controlling the refrigerator to run under the third operation condition when the environment temperature is smaller than or equal to T.

As a further improvement of this invention, controlling the refrigeration amount of the linear compressor under the second operation condition to be larger than refrigeration amount of the linear compressor under the first operation condition comprises: in a case where a refrigerator load does not vary, controlling a refrigeration amount per unit volume of a refrigerant in a freezing loop of the refrigerator under the second operation condition to be larger than a refrigeration amount per unit volume of the refrigerant in the freezing loop of the refrigerator under the first operation condition.

As a further improvement of this invention, the method further comprises: monitoring an operation status of the linear compressor; when the operation status of the linear compressor becomes abnormal, changing the operation condition of the refrigerator so as to increase the refrigeration amount per unit volume of the refrigerant in the freezing loop of the refrigerator; and after the operation status of the linear compressor becomes normal, setting a current operation condition of the refrigerator as the second operation condition.

As a further improvement of this invention, the method further comprises: monitoring an operation status of the linear compressor; when the operation status of the linear compressor becomes abnormal, changing the operation condition of the refrigerator so as to increase the refrigeration amount per unit volume of the refrigerant in the freezing loop of the refrigerator; and after the operation status of the linear compressor becomes normal, setting a current operation condition of the refrigerator as a third operation condition, associating the third operation condition with the environment temperature T, and controlling the refrigerator to run under the third operation condition when the environment temperature is smaller than or equal to T.

As a further improvement of this invention, monitoring an operation status of the linear compressor comprises: determining whether the linear compressor stops unexpectedly during its running within the predetermined time; and if yes, taking the operation status of the linear compressor as abnormal.

Accordingly, this invention provides a refrigerator controlling system with a linear compressor. The system comprises a temperature monitoring device and a main control board connected with the temperature monitoring device. The temperature monitoring device is configured to monitor an environment temperature T of the refrigerator located in the environment. The main control board is configured to compare the environment temperature T with a preset environment temperature threshold T0. The main control board is further configured to control a refrigerating unit and/or a heating unit in the refrigerator. If T is larger than T0, the main control board controls a refrigerating unit and/or a heating unit in the refrigerator such that the refrigerator runs under a first operation condition. If T is smaller than or equal to T0, the main control board controls the refrigerating unit and/or the heating unit in the refrigerator such that the refrigerator runs under a second operation condition. When the linear compressor runs within predetermined time, refrigeration amount of the linear compressor under the second operation condition is controlled to be larger than refrigeration amount of the linear compressor under the first operation condition, such that a compartment of the refrigerator reaches a target temperature.

As a further improvement of this invention, the main control board is further configured to: in a case where a refrigerator load does not vary, control a refrigeration amount required by a freezing compartment of the refrigerator under the second operation condition to be larger than a refrigeration amount required by the freezing compartment of the refrigerator under the first operation condition.

As a further improvement of this invention, the main control board is further configured to: monitor an operation status of the linear compressor; when the operation status of the linear compressor becomes abnormal, change the operation condition of the refrigerator so as to increase the refrigeration amount required by the freezing compartment of the refrigerator when the linear compressor runs within the predetermined time; and after the operation status of the linear compressor becomes normal, set a current operation condition of the refrigerator as the second operation condition.

As a further improvement of this invention, the main control board is further configured to: monitor an operation status of the linear compressor; when the operation status of the linear compressor becomes abnormal, change the operation condition of the refrigerator so as to increase the refrigeration amount required by the freezing compartment of the refrigerator when the linear compressor runs within the predetermined time; and after the operation status of the linear compressor becomes normal, set a current operation condition of the refrigerator as a third operation condition, associate the third operation condition with the environment temperature T, and control the refrigerator to run under the third operation condition when the environment temperature is smaller than or equal to T.

As a further improvement of this invention, the main control board is further configured to: in a case where a refrigerator load does not vary, control a refrigeration amount per unit volume of a refrigerant in a freezing loop of the refrigerator under the second operation condition to be larger than a refrigeration amount per unit volume of the refrigerant in the freezing loop of the refrigerator under the first operation condition.

As a further improvement of this invention, the main control board is further configured to: monitor an operation status of the linear compressor; when the operation status of the linear compressor becomes abnormal, change the operation condition of the refrigerator so as to increase the refrigeration amount per unit volume of the refrigerant in the freezing loop of the refrigerator; and after the operation status of the linear compressor becomes normal, set a current operation condition of the refrigerator as the second operation condition.

As a further improvement of this invention, the main control board is further configured to: monitor an operation status of the linear compressor; when the operation status of the linear compressor becomes abnormal, change the operation condition of the refrigerator so as to increase the refrigeration amount per unit volume of the refrigerant in the freezing loop of the refrigerator; and after the operation status of the linear compressor becomes normal, set a current operation condition of the refrigerator as a third operation condition, associate the third operation condition with the environment temperature T, and control the refrigerator to run under the third operation condition when the environment temperature is smaller than or equal to T.

As a further improvement of this invention, the main control board is further configured to: determine whether the linear compressor stops unexpectedly during its running within the predetermined time; and if yes, take the operation status of the linear compressor as abnormal.

The beneficial effects of this invention are given as follows.

According to this invention, the operation condition of the linear compressor is controlled by means of the refrigerating unit and/or the heating unit in the refrigerator so as to increase the stroke of the piston in the linear compressor, thereby preventing the refrigerator from not running normally due to protection of a frequency conversion plate to the linear compressor.

DETAILED DESCRIPTION

Figure 1:
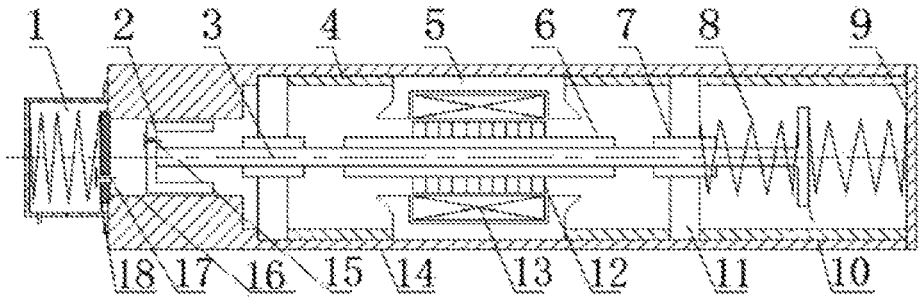
Fig. 1 (Prior Art)
FIG. 1 is a schematic drawing illustrating a structure of a linear compressor in the prior art.

In order to make the purposes, technical solutions and advantages of the invention more clear, specific embodiments of this invention are described in accompany with the drawings as follows. These preferred embodiments are exemplified in the drawings. Embodiments of this invention as illustrated in the drawings and described in accordance with the drawings are merely illustrative, and this invention is not limited to these embodiments.

It is to be noted that, in order to avoid blurring the invention because of unnecessary details, the drawings only show the structures and/or processing steps which are closely related to the solutions of this invention, but omit other details with little relationship with this invention.

In addition, it is also to be noted that, the terms "comprise" and "include" or any of their other variants aim to cover non-exclusive containing relationships, so that the processes, methods, articles or equipment including a series of elements not only include those elements, but also include other elements not explicitly listed, or also include elements inherent in these processes, methods, articles or equipment.

Figure 2:
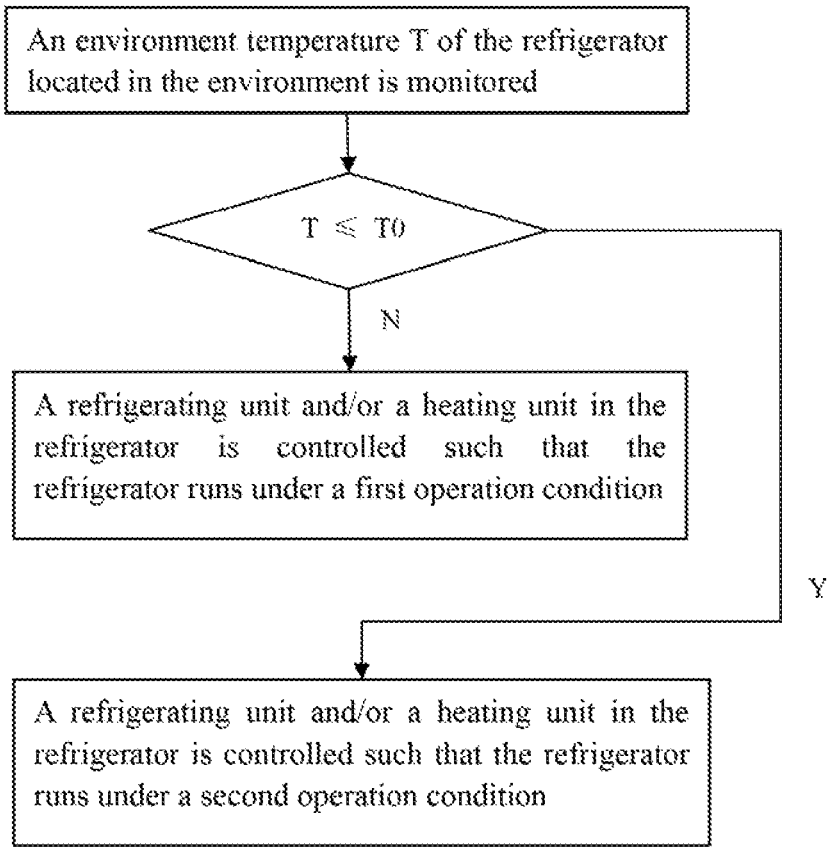
FIG. 2 is a flow chart illustrating a refrigerator controlling method according to this invention.

As shown in FIG. 2, this invention discloses a refrigerator controlling method with a linear compressor. The controlling method comprises: monitoring an environment temperature T of the refrigerator located in the environment; comparing the environment temperature T with a preset environment temperature threshold T0; if T is larger than T0, controlling a refrigerating unit and/or a heating unit in the refrigerator, such that the refrigerator runs under a first operation condition; and if T is smaller than or equal to T0, controlling the refrigerating unit and/or the heating unit in the refrigerator, such that a compartment of the refrigerator runs under a second operation condition.

When the linear compressor runs within predetermined time, a refrigeration amount of the linear compressor under the second operation condition is controlled to be larger than a refrigeration amount of the linear compressor under the first operation condition, such that a compartment of the refrigerator reaches a target temperature.

Figure 3:
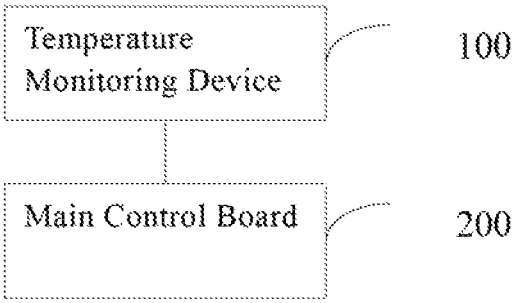
FIG. 3 is a schematic drawing illustrating the modules of a refrigerator controlling system according to this invention.

Accordingly, as shown in FIG. 3, this invention further discloses a refrigerator controlling system with a linear compressor. The controlling system comprises a temperature monitoring device 100 and a main control board 200 connected with the temperature monitoring device.

The temperature monitoring device 100 is configured to monitor an environment temperature T of the refrigerator located in the environment.

The main control board 200 is configured to compare an environment temperature T with a preset environment temperature threshold T0.

The main control board 200 is further configured to control a refrigerating unit and/or a heating unit in the refrigerator. That is, if T is larger than T0, the main control board 200 controls the refrigerating unit and/or the heating unit in the refrigerator, such that the refrigerator runs under a first operation condition, and if T is smaller than or equal to T0, the main control board 200 controls a refrigerating unit and/or a heating unit in the refrigerator, such that the refrigerator runs under a second operation condition.

When the linear compressor runs within the predetermined time, the refrigeration amount of the linear compressor under the second operation condition is controlled to be larger than the refrigeration amount of the linear compressor under the first operation condition, such that a compartment of the refrigerator reaches a target temperature.

In this invention, controlling the refrigeration amount of the linear compressor under the second operation condition to be larger than refrigeration amount of the linear compressor under the first operation condition specially includes the following two cases.

Case 1: detailed reference can be made to the following first to fifth embodiments. In a case where a refrigerator load does not vary, the operating parameters of the refrigerator are controlled to increase the refrigeration amount required by a freezing compartment of the refrigerator under a second operation condition so as to be larger than refrigeration amount required by the freezing compartment of the refrigerator under the first operation condition.

Case 2: detailed reference can be made to the following sixth to eleventh embodiments. In a case where a refrigerator load does not vary, the operating parameters of the refrigerator are controlled to increase the refrigeration amount per unit volume of a refrigerant in a freezing loop of the refrigerator under a second operation condition so as to be larger than the refrigeration amount per unit volume of the refrigerant in the freezing loop of the refrigerator under the first operation condition.

For the first case, the controlling method of this invention further comprises: monitoring an operation status of the linear compressor; when the operation status of the linear compressor becomes abnormal, changing the operation condition of the refrigerator so as to increase the refrigeration amount required by the freezing compartment of the refrigerator when the linear compressor runs within the predetermined time; and after the operation status of the linear compressor becomes normal, setting a current operation condition of the refrigerator as the second operation condition.

Or, the controlling method further comprises: monitoring an operation status of the linear compressor; when the operation status of the linear compressor becomes abnormal, changing the operation condition of the refrigerator so as to increase the refrigeration amount required by the freezing compartment of the refrigerator when the linear compressor runs within the predetermined time; and after the operation status of the linear compressor becomes normal, setting a current operation condition of the refrigerator as a third operation condition, associating the third operation condition with the environment temperature T, and controlling the refrigerator to run under the third operation condition when the environment temperature is smaller than or equal to T.

For the second case, the controlling method of this invention further comprises: monitoring an operation status of the linear compressor; when the operation status of the linear compressor becomes abnormal, changing the operation condition of the refrigerator so as to increase the refrigeration amount per unit volume of refrigerant in the freezing loop of the refrigerator; and after the operation status of the linear compressor becomes normal, setting a current operation condition of the refrigerator as the second operation condition.

Or, the controlling method of this invention further comprises: monitoring an operation status of the linear compressor; when the operation status of the linear compressor becomes abnormal, changing the operation condition of the refrigerator so as to increase the refrigeration amount per unit volume of a refrigerant in the freezing loop of the refrigerator; and after the operation status of the linear compressor becomes normal, setting a current operation condition of the refrigerator as a third operation condition, associating the third operation condition with the environment temperature T, and controlling the refrigerator to run under the third operation condition when the environment temperature is smaller than or equal to T.

The "predetermined time" defined in this invention keeps the same. That is, running time of the linear compressor keeps constant in different periods, while heating parameters of heating devices within "predetermined time" may vary.

Further, all the embodiments of this invention are described in a case where a refrigerator load does not vary, without considering the case where external articles are put into the refrigerator to cause the temperature inside the refrigerator to vary. For example, it will increase the refrigeration amount required by the refrigerator upon putting high-temperature food and the like into the refrigerator during the refrigerator's operation.

Further description will be made to this invention in accompany with each embodiment.

Figure 4:
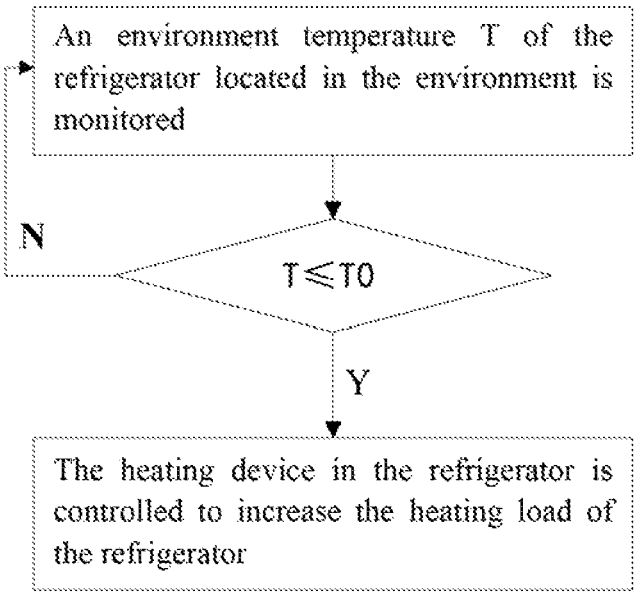
FIG. 4 is a detailed flow chart illustrating a refrigerator controlling method according to a first embodiment of this invention.

As shown in FIG. 4, a refrigerator controlling method using a linear compressor according to the first embodiment of this invention is depicted. The controlling method comprises: monitoring an environment temperature T of the refrigerator located in the environment; comparing the environment temperature T with a preset environment temperature threshold T0; if T is smaller than or equal to T0, controlling the heating device in the refrigerator to increase the heating load in the refrigerator, such that the stroke of the piston in the linear compressor is increased when the linear compressor runs within predetermined time.

Accordingly, this embodiment further discloses a refrigerator controlling system with a linear compressor. The system comprises a temperature monitoring device and a main control board connected with the temperature monitoring device.

The temperature monitoring device is used for monitoring the environment temperature T of the refrigerator located in the environment.

The main control board is used for comparing the environment temperature T with a preset environment temperature threshold T0.

The main control board is also used for controlling the heating device in the refrigerator. If T is smaller than or equal to T0, the main control board controls the heating device in the refrigerator to increase the heating load of the refrigerator, so that the stroke of the piston in the linear compressor is increased when the linear compressor runs within the predetermined time.

Preferably, the environment temperature T in this embodiment is acquired by a temperature sensor. The temperature sensor is arranged on a refrigerator box. Certainly, the acquisition may be implemented through some other temperature monitoring device, such as a thermometer and the like besides the temperature sensor.

This invention pertains to a controlling method with respect to a refrigerator at a low temperature. The preset environment temperature threshold T0 prescribes a threshold value on the "low temperature" in this invention. For example, the preset environment temperature threshold T0 may be set as 10° C. Accordingly, any case where the environment temperature T≤10° C. falls within the scope of the low temperature. However, 10° C. is only an optional threshold of the environment temperature in this invention, and other temperatures such as 5° C., 0° C. and the like may be set in other embodiments. When the preset environment temperature threshold T0 is set as another temperature, the definition of "low temperature" varies accordingly.

When a general refrigerator runs at a low temperature (the environment temperature is smaller than or equal to a preset environment temperature threshold), the heating load of the refrigerator is relatively low, and refrigeration amount required by compartments also become relatively low. In this case, a linear compressor runs with a relatively low output power, resulting in a small stroke of the piston in the linear compressor. Thus, the piston may collide with an exhaust valve plate, causing damage to mechanical parts. Existing frequency conversion plate of the linear compressor usually sets up a frequency conversion protection program. When the piston collides with the exhaust valve plate, the frequency conversion protection program will be launched, so that the refrigerator stops running. In order to avoid protection by the frequency conversion plate to the linear compressor, it is necessary to change the operation condition of the refrigerator in a compulsory manner when it works at a low temperature.

In this embodiment, if T is smaller than or equal to T0, i.e., the refrigerator is in a low temperature status, the heating device in the refrigerator is controlled to increase the heating load of the refrigerator, so that the stroke of the piston in the linear compressor is increased when the linear compressor runs within predetermined time.

In this embodiment, the heating device is a defrosting heating wire arranged on a refrigerator evaporator. In other embodiments, it may be other heating devices provided in the refrigerator. The heating device can change the operation condition inside the refrigerator.

Further, in this embodiment, controlling the heating device in the refrigerator to increase the heating load of the refrigerator comprises: adjusting a first heating parameter of the heating device when T is larger than T0 to a second heating parameter. The second heating parameter includes heating time, heating temperature and heating frequency, at least one of which is larger than that of the first heating parameter. After at least one of the heating time, heating temperature and heating frequency among the heating parameter is increased, the heating load of the refrigerator will be increased accordingly, causing an increase of the refrigeration amount supplied from the refrigeration loop. Since the total amount of the refrigerant per unit time is constant, it is necessary to increase the output power of the linear compressor. The output power of the linear compressor is related to the stroke of the piston. Therefore, the stroke of the linear compressor can be increased to achieve the effect of increasing the heat load of the refrigerator. After the stroke of the piston in the linear compressor is increased, it prevents collision between the piston and the exhaust valve plate, and the frequency conversion plate will not launch the frequency conversion protection program, so that the refrigerator can run normally.

Specially, in an embodiment of this invention, as an example, the heating time among the heating parameters is increased while the heating temperature and the heating frequency remain unchanged.

When the refrigerator runs under a first operation condition (i.e., T is larger than T0), among the first heating parameter of the heating device, the heating time is 3 min. An environment temperature T of the refrigerator located in the environment is detected. The environment temperature T is compared with a preset environment temperature threshold T0. In this embodiment, T0 is 10° C. When T≤10° C., the heating time among the heating parameters of the heating device in the refrigerator is controlled to increase by a preset value (1 min). That is, the heating time of the heating device is changed from 3 min in the first heating parameter to 4 min in the second heating parameter, such that the refrigerator runs under a second operation condition. According to the above discussion, the stroke of the piston can be increased just after the increase of the heating time, thereby preventing collision between the piston and the exhaust valve plate.

In other embodiments, the method of increasing heating temperature and heating frequency is similar to that of heating time and is no longer detailed. Certainly, in other embodiments, it may also increase multiple of the heating time, heating temperature and heating frequency by a preset value to control the heating device.

A refrigerator controlling method with a linear compressor according to the second embodiment of this invention is depicted as follows. The controlling method comprises: monitoring an environment temperature T of the refrigerator located in the environment; comparing the environment temperature T with a preset environment temperature threshold T0; if T is smaller than or equal to T0, controlling the heating device in the refrigerator to increase the heating load of the refrigerator, such that the stroke of the piston in the linear compressor is increased when the linear compressor runs within predetermined time.

Figure 5:
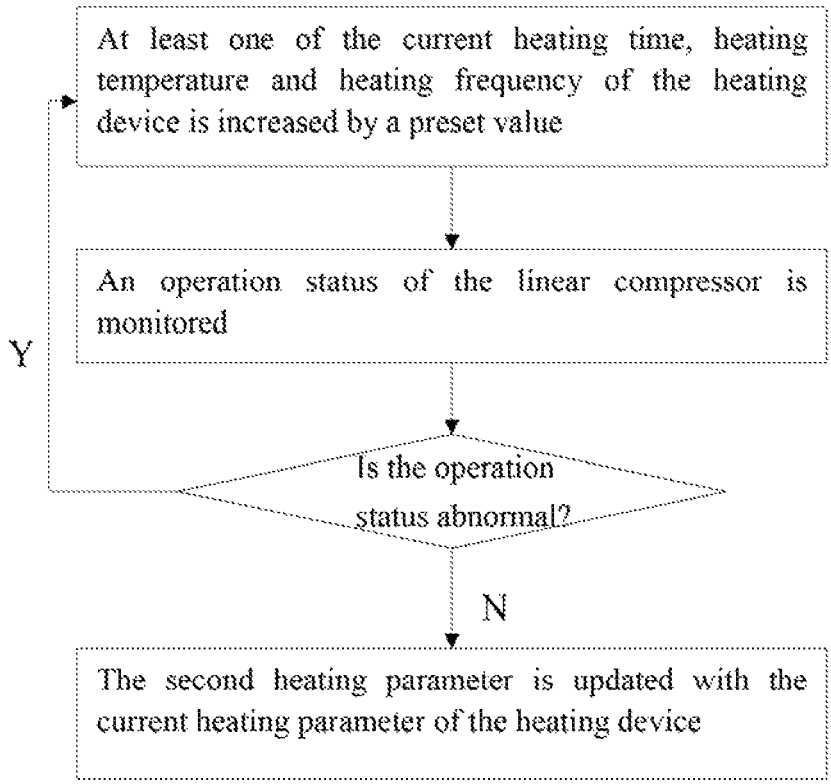
FIG. 5 is a detailed flow chart illustrating a refrigerator controlling method according to a second embodiment of this invention.

The foregoing steps are the same as those in the first embodiment and not detailed any more. In this embodiment, when T is smaller than or equal to T0, among heating parameters of the heating device, at least one of the heating time, heating temperature and heating frequency is increased by a preset value. However, if the increase of the heating time, heating temperature and heating frequency is not large enough, it can only solve the problem that the piston collides with the exhaust valve plate within a certain period of time. After the certain period of time, the refrigerator may also stop running because of frequency conversion protection. Therefore, as shown in FIG. 5, the controlling method in this embodiment further comprises: monitoring an operation status of the linear compressor; when the operation status of the linear compressor becomes abnormal, increasing at least one of a current heating time, heating temperature, heating frequency of the heating device by a preset value; and after the operation status of the linear compressor becomes normal, updating a second heating parameter with the current heating parameter of the heating device.

In this embodiment, determining whether "the operation status of the linear compressor becomes abnormal" comprises: determining whether the linear compressor stops unexpectedly during its running within the predetermined time; and if yes, taking the operation status of the linear compressor as abnormal.

Similar to the first embodiment, in this embodiment, a refrigerator controlling system with a linear compressor also comprises a temperature monitoring device and a main control board connected with the temperature monitoring device.

The temperature monitoring device is configured to monitor an environment temperature T of the refrigerator located in the environment.

The main control board is configured to compare the environment temperature T with a preset environment temperature threshold T0.

The main control board is further configured to control the heating device in the refrigerator. If T is smaller than or equal to T0, the main control board controls the heating device in the refrigerator to increase the heating load of the refrigerator, such that the stroke of the piston in the linear compressor is increased when the linear compressor runs within the predetermined time.

Specifically, the main control board increases at least one of the heating time, heating temperature and heating frequency preset by the heating device by a predetermined range, so as to increase the heating load of the compartments of the refrigerator.

Further, in this embodiment, the main control board is configured to monitor an operation status of the linear compressor.

When the operation status of the linear compressor becomes abnormal, at least one of current heating time, heating temperature, heating frequency of the heating device is increased by a preset value.

After the operation status of the linear compressor becomes normal, a current heating parameter of the heating device is set as the heating parameter launched by the heating device when the environment temperature is smaller than or equal to T0.

In this embodiment, by updating the heating time, heating temperature and heating frequency among the second heating parameter of the heating device, if it still exists in the linear compressor that the piston collides with the exhaust valve plate after increasing at least one of the heating time, heating temperature and heating frequency of the heating device, then continue to increase at least one of the heating time, heating temperature and heating frequency until the linear compressor runs normally. There is no collision between the piston and the exhaust valve plate during running.

In the meantime, a second heating parameter during the linear compressor's running normally is set as the heating parameter launched by the heating device when the environment temperature is smaller than or equal to T. If the environment temperature is smaller than or equal to T, the linear compressor controls the heating device by an updated second heating parameter, which can ensure that no abnormity occurs in the refrigerator during the next operation.

Specifically, in an embodiment of this invention, as an example, among the heating parameters, the heating time of the heating device is increased while the heating temperature and the heating frequency remain unchanged.

When the refrigerator runs normally under the first operation condition, the heating time of the heating device is 3 min. The environment temperature T of the refrigerator located in the environment is detected and the environment temperature T is compared with a preset environment temperature threshold T0. In this embodiment, T0 is 10° C. When T≤10° C., the heating device in the refrigerator is controlled so that heating time is increased by a preset value (1 min). That is, the heating time of the heating device becomes 4 min, such that the refrigerator runs under the second operation condition.

The operation status of the linear compressor is monitored. When the operation status of the linear compressor becomes abnormal, the heating time keeps increasing by a preset value (1 min), until it is monitored that the operation status of the linear compressor is back to normal. In this embodiment, after increased twice, the operation status of the linear compressor becomes normal. At this moment, the heating time of the heating device is 5 min, and the heating time 5 min is updated to the second heating parameter. When the environment temperature is T≤10° C. next time, the heating device performs heating directly by the heating time 5 min in the second heating parameter. During the next running of the linear compressor, the heating device performs heating by the heating time 5 min. If the environment temperature varies, the operation status of the linear compressor keeps being monitored. If the operation status of the linear compressor becomes abnormal, the heating time keeps increasing by a preset value. For example, when it is increased to 6 min, the linear compressor runs normally and the heating time in the second heating parameter is updated to 6 min. At this moment, the operation condition under which the refrigerator runs is the second operation condition, and the whole controlling process of the heating time is a dynamic cycle. After starting up, there is no need for the heating device to increase from the beginning first heating parameter.

Further, in this embodiment, the second heating parameter is associated with the environment temperature T. That is, the environment temperature T is associated with the heating time among the second heating parameter of the heating device. As in this embodiment, the monitored environment temperature T is 0° C., and the heating time among the second heating parameter of the heating device is 5 min. Then the heating time (5 min) is set as an initial value at the heating device's starting up when the environment temperature is smaller than or equal to 0° C. When in the next time the environment temperature is smaller than or equal to 0° C., the heating device performs heating by the heating time 5 min as a default value and keeps monitoring the operation status of the linear compressor. If the operation status of the linear compressor becomes abnormal, the heating time keeps increasing by a preset value. For example, when it is increased to 6 min, the linear compressor runs normally and in the meantime, the heating time in the second heating parameter is updated to 6 min and associated with the current temperature 0° C.

If the heating time associated with the environment temperature 0° C. is 5 min and the monitored environment temperature during the next running is 0° C.-10° C., then the heating time in the first heating parameter is 3 min. In the meantime, the operation status of the linear compressor keeps being monitored. If the compressor becomes abnormal, the foregoing process of increasing by a preset value is repeated. The whole process of controlling the heating time is also a dynamic cycle.

Likewise, in other embodiments, the method of increasing the heating temperature and heating frequency is similar to the foregoing method of increasing the heating time and is not detailed any more. Certainly, in other embodiments, it is possible to increase multiple of the heating time, heating temperature and heating frequency among the heating parameter by a preset value to control the heating device.

Figure 6:
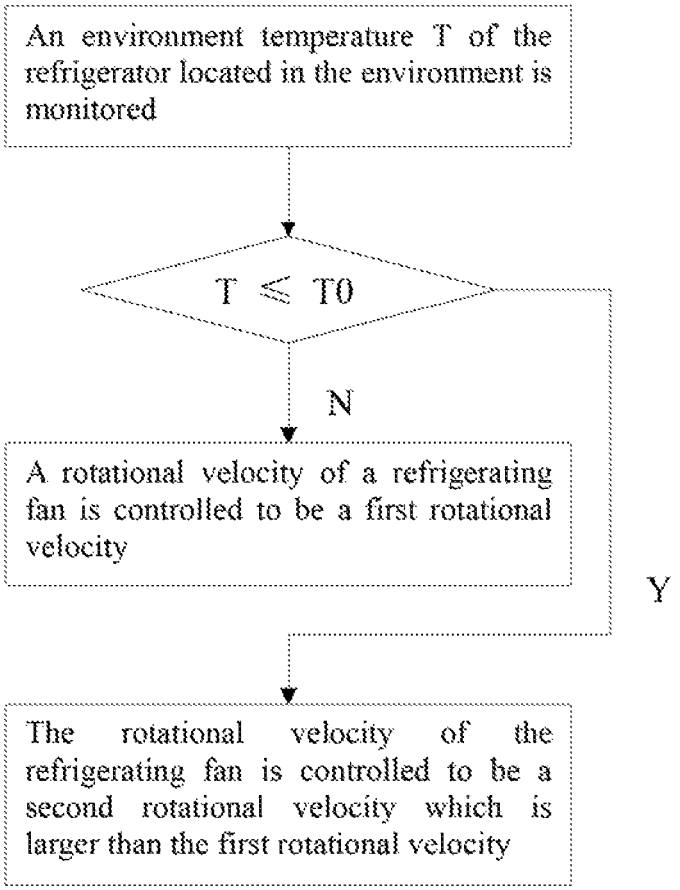
FIG. 6 is a detailed flow chart illustrating a refrigerator controlling method according to a third embodiment of this invention.

As shown in FIG. 6, a refrigerator controlling method with a linear compressor according to the third embodiment of this invention is depicted. In this embodiment, the refrigerator is an air-cooling refrigerator which is provided with a refrigerating fan arranged between a refrigerating chamber and a freezing chamber for heat exchange. The controlling method comprises: monitoring an environment temperature T of the refrigerator located in the environment; comparing the environment temperature T with a preset environment temperature threshold T0; if T is larger than T0, controlling a rotational velocity of a refrigerating fan to be a first rotational velocity when the linear compressor runs within predetermined time; and if T is smaller than or equal to T0, controlling the rotational velocity of the refrigerating fan to be a second rotational velocity when the linear compressor runs within predetermined time. The second rotational velocity is larger than the first rotational velocity.

Accordingly, in this embodiment, there is also disclosed a refrigerator controlling system with a linear compressor. The system comprises a temperature monitoring device and a main control board connected with the temperature monitoring device.

The temperature monitoring device is configured to monitor an environment temperature T of the refrigerator located in the environment.

The main control board is configured to compare the environment temperature T with a preset environment temperature threshold T0.

The main control board is further configured to control a rotational velocity of a refrigerating fan. If T is larger than T0, the rotational velocity of the refrigerating fan is controlled to be a first rotational velocity when the linear compressor runs within predetermined time. If T is smaller than or equal to T0, the rotational velocity of the refrigerating fan is controlled to be a second rotational velocity when the linear compressor runs within predetermined time. The second rotational velocity is larger than the first rotational velocity.

In this embodiment, if T is larger than T0, the rotational velocity of the refrigerating fan is controlled to be the first rotational velocity. If T is smaller than or equal to T0, the rotational velocity of the refrigerating fan is controlled to be the second rotational velocity. The second rotational velocity is larger than the first rotational velocity. In this way, heat exchange between a refrigerating chamber and a freezing chamber in the refrigerator is speeded up and more refrigeration amount is required when the linear compressor runs within predetermined time. In addition, the refrigeration amount of the linear compressor is associated with the stroke of an internal piston. The greater the stroke of the piston is, the more work the piston does in unit time, thereby improving more refrigeration amount. Thus, the stroke of the piston in the linear compressor can be increased by increasing the rotational velocity of the refrigerating fan.

If the environment temperature T is lower than the preset environment temperature threshold T0, the heating load of the refrigerator is relatively low, and accordingly, the refrigeration amount required by compartments is relatively low. In a case where the refrigeration amount is rated, if the refrigeration loop still performs refrigerating in a normal condition, the piston stroke of the compressor will be decreased. The refrigerator in this embodiment is an air-cooling single system refrigerator, which increases the stroke of the piston in the linear compressor when the linear compressor runs within predetermined time, by increasing a rotational velocity of a refrigerating fan for heat exchange between a refrigerating chamber and a freezing chamber. Thus, it prevents collision between the piston and the exhaust valve plate, and the frequency conversion plate will not launch the frequency conversion protection program, so that the refrigerator can run normally.

In a specific embodiment of this invention, a preset environment temperature threshold T0 is 10° C. When the environment temperature T is higher than 10° C. and the linear compressor of the refrigerator runs under a first operation condition, the rotational velocity of the refrigerating fan is a first rotational velocity 2,000 r/min. When it is monitored that the environment temperature T is smaller than or equal to T0, e.g., the environment temperature is 0° C., then the rotational velocity of the refrigerating fan is controlled to be a second rotational velocity 2,200 r/min during running of the linear compressor. At this moment, the operation condition of the refrigerator is the second operation condition. As such, heat exchange between the refrigerating chamber and the freezing chamber can be speeded up. In other words, the refrigeration amount required by the refrigerator in unit time is increased. The stroke of the piston in the linear compressor will be increased.

A refrigerator controlling method using a linear compressor according to the fourth embodiment of this invention is depicted as follows. The refrigerator in this embodiment is an air-cooling refrigerator, which is provided with a refrigerating fan arranged between a refrigerating chamber and a freezing chamber for heat exchange. The controlling method comprises: monitoring an environment temperature T of the refrigerator located in the environment; comparing the environment temperature T with a preset environment temperature threshold T0; if T is larger than T0, controlling a rotational velocity of a refrigerating fan to be a first rotational velocity when the linear compressor runs within predetermined time; and if T is smaller than or equal to T0, controlling the rotational velocity of the refrigerating fan to be a second rotational velocity when the linear compressor runs within predetermined time. The second rotational velocity is larger than the first rotational velocity.

Figure 7:
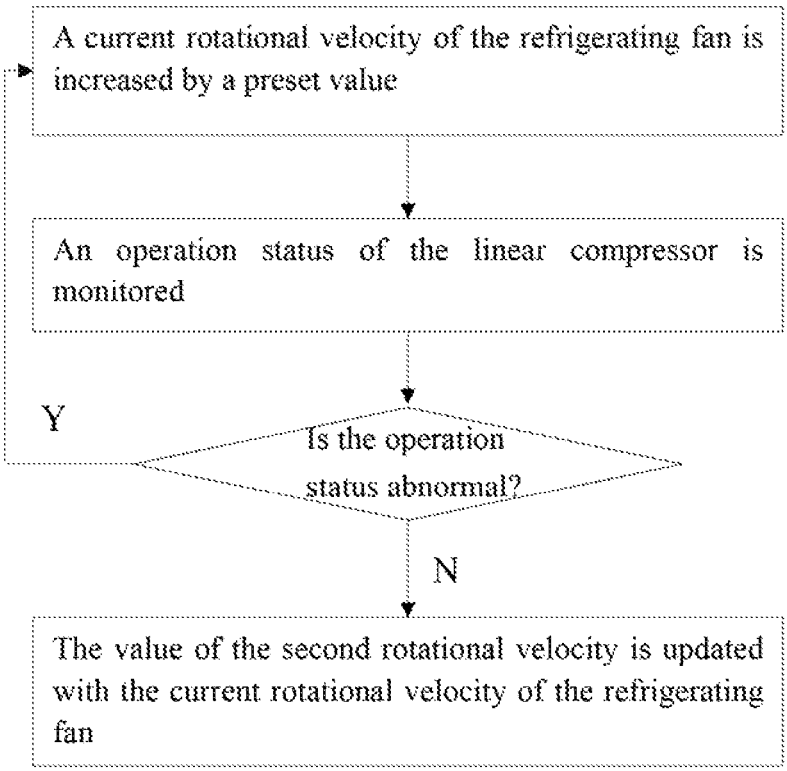
FIG. 7 is a detailed flow chart illustrating a refrigerator controlling method according to a fourth embodiment of this invention.

The foregoing steps are the same as those in the third embodiment. Further, as shown in FIG. 7, in this embodiment, it further comprises: monitoring an operation status of the linear compressor; when the operation status of the linear compressor becomes abnormal, increasing by a preset value from a current rotational velocity of the refrigerating fan; and after the operation status of the linear compressor becomes normal, updating the value of the second rotational velocity with the current rotational velocity of the refrigerating fan.

Monitoring an operation status of a linear compressor further comprises: determining whether the linear compressor stops unexpectedly during its running within the predetermined time; and if yes, taking the operation status of the linear compressor as abnormal.

Accordingly, in this embodiment, there is also disclosed a refrigerator controlling system using a linear compressor. The system comprises a temperature monitoring device and a main control board connected with the temperature monitoring device.

The temperature monitoring device is configured to monitor an environment temperature T of the refrigerator located in the environment.

The main control board is configured to compare the environment temperature T with a preset environment temperature threshold T0.

The main control board is further configured to control a rotational velocity of a refrigerating fan. If T is larger than T0, the rotational velocity of the refrigerating fan is controlled to be a first rotational velocity when the linear compressor runs within predetermined time. If T is smaller than or equal to T0, the rotational velocity of the refrigerating fan is controlled to be a second rotational velocity when the linear compressor runs within predetermined time. The second rotational velocity is larger than the first rotational velocity.

The main control board is further configured to monitor an operation status of the linear compressor. When the operation status of the linear compressor becomes abnormal, it is increased by a preset value from a current rotational velocity of the refrigerating fan. After the operation status of the linear compressor becomes normal, the value of the second rotational velocity is updated with the current rotational velocity of the refrigerating fan.

In a specific embodiment of this invention, a preset environment temperature threshold T0 is 10° C., and a monitored environment temperature T is 0° C. which is lower than the preset environment temperature threshold 10° C. The rotational velocity of the refrigerating fan is controlled to be 2200 r/min to increase the stroke of the piston in the linear compressor. At this moment, the operation condition of the refrigerator is the second operation condition. Thereafter, the operation status of the linear compressor is monitored. If the linear compressor runs abnormally, the rotational velocity of the refrigerating fan keeps increasing by a preset value 100 r/min and the rotational velocity of the refrigerating fan is increased to 2,300 r/min.

Further, after the rotational velocity of the refrigerating fan is increased to 2,300 r/min, the operation status of the linear compressor keeps being monitored. If the linear compressor runs abnormally, the rotational velocity of the refrigerating fan keeps increasing by a preset value 100 r/min until the linear compressor runs normally. In this embodiment, after the linear compressor runs normally, the rotational velocity of the refrigerating fan is 2500 r/min. At this moment, the operation condition of the refrigerator is the third operation condition and a preset value of the second rotational velocity is updated to a current rotational velocity of a refrigerating fan (2,500 r/min) in the meantime. Thereafter, if the environment temperature is lower than 10° C., the rotational velocity of the refrigerating fan is directly controlled to be 2,500 r/min when the linear compressor runs within predetermined time. The process of controlling the rotational velocity of the refrigerating fan is a dynamic cycle. When the linear compressor starts up at a low temperature, there is no need for the refrigerating fan to increase by a preset value from a preset first rotational velocity each time.

A refrigerator controlling method using a linear compressor according to the fifth embodiment of this invention is depicted as follows. The refrigerator in this embodiment is an air-cooling refrigerator, which is provided with a refrigerating fan arranged between a refrigerating chamber and a freezing chamber for heat exchange. The controlling method comprises: monitoring an environment temperature T of the refrigerator located in the environment; comparing the environment temperature T with a preset environment temperature threshold T0; if T is larger than T0, a rotational velocity of a refrigerating fan is controlled to be a first rotational velocity when the linear compressor runs within predetermined time; and if T is smaller than or equal to T0, the rotational velocity of the refrigerating fan is controlled to be a second rotational velocity when the linear compressor runs within predetermined time. The second rotational velocity is larger than the first rotational velocity.

Figure 8:
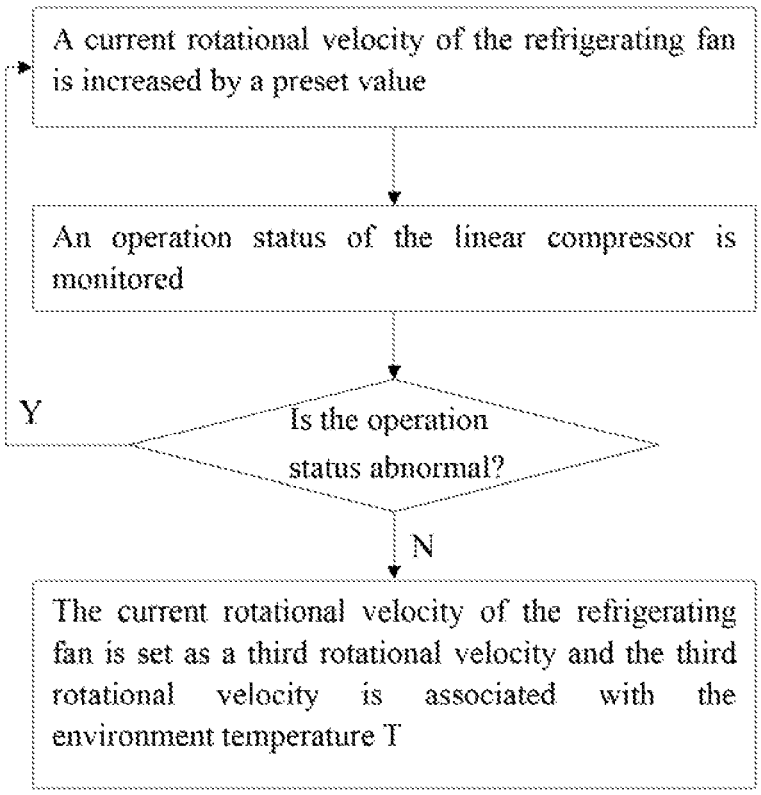
FIG. 8 is a detailed flow chart illustrating a refrigerator controlling method according to a fifth embodiment of this invention.

The foregoing steps are the same as those in the third embodiment. Further, as shown in FIG. 8, in this embodiment, it further comprises: monitoring an operation status of the linear compressor; when the operation status of the linear compressor becomes abnormal, increasing by a preset value from a current rotational velocity of the refrigerating fan; and after the operation status of the linear compressor becomes normal, setting the current rotational velocity of the refrigerating fan as a third rotational velocity, associating the third rotational velocity with the environment temperature T, and controlling the rotational velocity of the refrigerating fan to be the third rotational velocity when the environment temperature is smaller than or equal to T.

Monitoring the operation status of the linear compressor comprises: determining whether the linear compressor stops unexpectedly during its running within the predetermined time; and if yes, taking the operation status of the linear compressor as abnormal.

Accordingly, in this embodiment, there is also provided a refrigerator controlling system using a linear compressor. The system comprises a temperature monitoring device and a main control board connected with the temperature monitoring device.

The temperature monitoring device is configured to monitor an environment temperature T of the refrigerator located in the environment.

The main control board is configured to compare the environment temperature T with a preset environment temperature threshold T0.

The main control board is further configured to control a rotational velocity of a refrigerating fan. If T is larger than T0, the rotational velocity of the refrigerating fan is controlled to be a first rotational velocity when the linear compressor runs within predetermined time. If T is smaller than or equal to T0, the rotational velocity of the refrigerating fan is controlled to be a second rotational velocity when the linear compressor runs within predetermined time. The second rotational velocity is larger than the first rotational velocity.

The main control board is further configured to monitor an operation status of the linear compressor. When the operation status of the linear compressor becomes abnormal, it is increased by a preset value from the current rotational velocity of the refrigerating fan. After the operation status of the linear compressor becomes normal, the current rotational velocity of the refrigerating fan is set as a third rotational velocity, the third rotational velocity is associated with the environment temperature T, and the rotational velocity of the refrigerating fan is controlled to be the third rotational velocity when the environment temperature is smaller than or equal to T.

In a specific embodiment of this invention, a preset environment temperature threshold T0 is 10° C., and a monitored environment temperature T is 0° C. which is lower than the preset environment temperature threshold 10° C. The rotational velocity of the refrigerating fan is controlled to be 2,200 r/min to increase the stroke of the piston in the linear compressor. At this moment, the operation condition of the refrigerator is the second operation condition. Thereafter, the operation status of the linear compressor is monitored. If the linear compressor runs abnormally, the rotational velocity of the refrigerating fan keeps increasing by a preset value 100 r/min and the rotational velocity of the refrigerating fan increases to 2,300 r/min.

Further, after the rotational velocity of the refrigerating fan is increased to 2,300 r/min, the operation status of the linear compressor keeps being monitored. If the linear compressor runs abnormally, the rotational velocity of the refrigerating fan keeps increasing by a preset value 100 r/min until the linear compressor runs normally. Furthermore, the current rotational velocity of the refrigerating fan is associated with the current environment temperature.

Specifically, in this embodiment, after the linear compressor runs normally, the rotational velocity of the refrigerating fan is 2,500 r/min. At this moment, the operation condition of the refrigerator is the third operation condition, the current rotational velocity of the refrigerating fan (2,500 r/min) is set as the third rotational velocity of the refrigerating fan, and the third rotational velocity 2500 r/min is associated with the current environment temperature 0° C. During the next running of the refrigerator, if it is monitored that the environment temperature is smaller than or equal to 0° C., the rotational velocity of the refrigerating fan is directly controlled to be the third rotational velocity 2,500 r/min. If it is monitored that the environment temperature is 0° C.-10° C., the rotational velocity of the refrigerating fan is controlled by still following the method in the fourth embodiment.

In this embodiment, the process of controlling the rotational velocity of the refrigerating fan is a dynamic cycle. When the refrigerator starts up at a low temperature, there is no need for the refrigerating fan to increase by a preset value from a preset rotational velocity each time.

Figure 9:
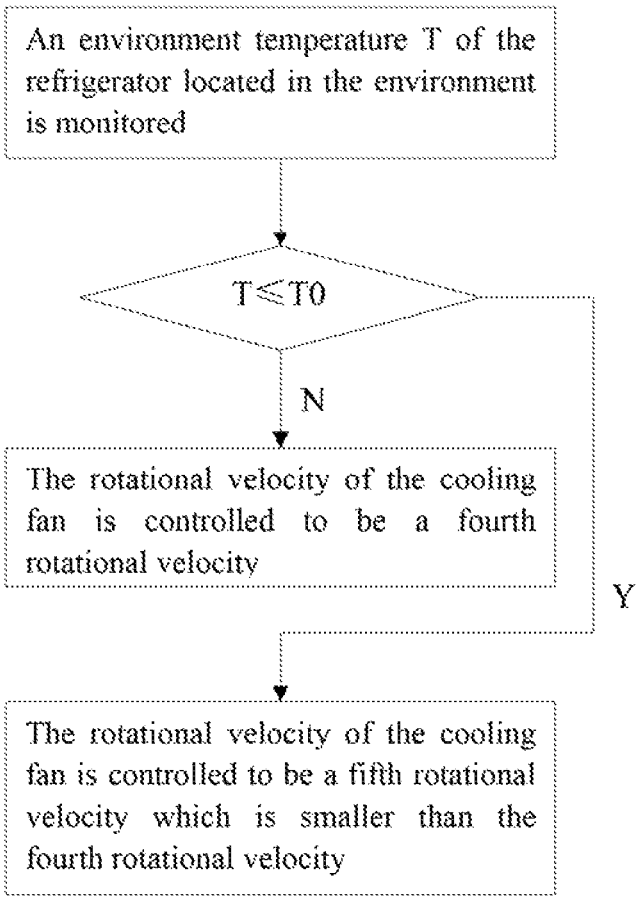
FIG. 9 is a detailed flow chart illustrating a refrigerator controlling method according to a sixth embodiment of this invention.

As shown in FIG. 9, a refrigerator controlling method using a linear compressor according to the sixth embodiment of this invention is depicted. The refrigerator in this embodiment is an air-cooling refrigerator or a direct cooling refrigerator. The refrigeration loop comprises an evaporator, a condenser, etc. A cooling fan is provided at the side of the condenser for radiating heat of the condenser. The controlling method comprises: monitoring an environment temperature T of the refrigerator located in the environment; comparing the environment temperature T with a preset environment temperature threshold T0; if T is larger than T0, controlling the rotational velocity of the cooling fan to be a fourth rotational velocity when the linear compressor runs within predetermined time, and if T is smaller than or equal to T0, controlling the rotational velocity of the cooling fan to be a fifth rotational velocity when the linear compressor runs within predetermined time. The fifth rotational velocity is smaller than the fourth rotational velocity.

Accordingly, in this embodiment, there is also provided a refrigerator controlling system using a linear compressor.

The system comprises a temperature monitoring device and a main control board connected with the temperature monitoring device.

The temperature monitoring device is configured to monitor an environment temperature T of the refrigerator located in the environment.

The main control board is configured to compare the environment temperature T with a preset environment temperature threshold T0.

The main control board is further configured to control the rotational velocity of the cooling fan. If T is larger than T0, the rotational velocity of the cooling fan is controlled to be a fourth rotational velocity when the linear compressor runs within predetermined time. If T is smaller than or equal to T0, the rotational velocity of the cooling fan is controlled to be a fifth rotational velocity when the linear compressor runs within predetermined time. The fifth rotational velocity is smaller than the fourth rotational velocity.

In this embodiment, if T is larger than T0, the rotational velocity of the cooling fan is controlled to be the fourth rotational velocity. If T is smaller than or equal to T0, the rotational velocity of the cooling fan is controlled to be the fifth rotational velocity. The fifth rotational velocity is smaller than the fourth rotational velocity. In this way, heat radiating rate of the condenser is slowed down. However, the refrigeration amount required by the refrigerator is rated under certain conditions, so a decrease of the rotational velocity of the cooling fan will result in a decrease of refrigeration amount supplied by the linear compressor in unit time. In order to maintain a rated refrigeration amount, the work done by the piston in the linear compressor needs to be increased. That is, the stroke of the piston needs to be increased. Thus, it can increase the stroke of the piston in the linear compressor by decreasing the rotational velocity of the cooling fan.

In a specific embodiment of this invention, a preset environment temperature threshold T0 is 10° C. When the environment temperature T is higher than 10° C. and the linear compressor is running, the rotational velocity of the cooling fan is a fourth rotational velocity 3,000 r/min. At this moment, the operation condition of the refrigerator is the first operation condition. When it is monitored that the environment temperature T is smaller than or equal to T0, e.g., the environment temperature is 0° C., then the rotational velocity of the cooling fan is controlled to be a fifth rotational velocity 2,800 r/min during running of the linear compressor. At this moment, the operation condition of the refrigerator is the second operation condition. As such, heat radiation of the condenser can be slowed down. In order to obtain a same refrigeration amount in unit time, the stroke of the piston in the linear compressor will increase.

A refrigerator controlling method using a linear compressor according to the seventh embodiment of this invention is depicted as follows. The refrigerator in this embodiment is an air-cooling refrigerator or a direct cooling refrigerator. The refrigeration loop comprises an evaporator, a condenser, etc. A cooling fan is provided at the side of the condenser for radiating heat of the condenser. The controlling method comprises: monitoring an environment temperature T of the refrigerator located in the environment; comparing the environment temperature T with a preset environment temperature threshold T0; if T is larger than T0, controlling the rotational velocity of the cooling fan to be a fourth rotational velocity when the linear compressor runs within predetermined time; and if T is smaller than or equal to T0, controlling the rotational velocity of the cooling fan to be a fifth rotational velocity when the linear compressor runs within predetermined time. The fifth rotational velocity is smaller than the fourth rotational velocity.

Figure 10:
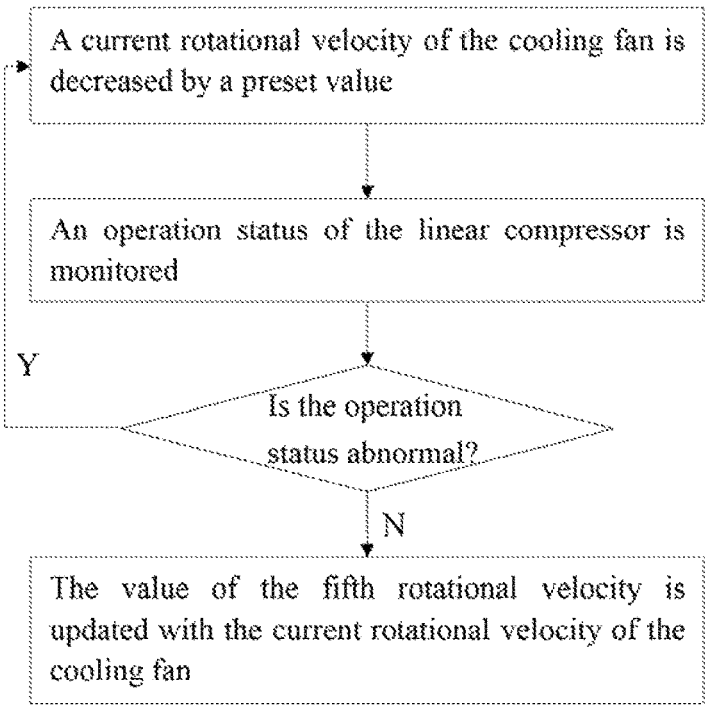
FIG. 10 is a detailed flow chart illustrating a refrigerator controlling method according to a seventh embodiment of this invention.

The foregoing steps are the same as those in the sixth embodiment. Further, as shown in FIG. 10, in this embodiment, it further comprises: monitoring an operation status of the linear compressor; when the operation status of the linear compressor becomes abnormal, decreasing by a preset value from a current rotational velocity of the cooling fan; and after the operation status of the linear compressor becomes normal, updating the value of the fifth rotational velocity with the current rotational velocity of the cooling fan.

Monitoring the operation status of the linear compressor comprises: determining whether the linear compressor stops unexpectedly during its running within the predetermined time; and if yes, taking the operation status of the linear compressor as abnormal.

Accordingly, in this embodiment, there is also provided a refrigerator controlling system using a linear compressor. The system comprises a temperature monitoring device and a main control board connected with the temperature monitoring device.

The temperature monitoring device is configured to monitor an environment temperature T of the refrigerator located in the environment.

The main control board is configured to compare the environment temperature T with a preset environment temperature threshold T0.

The main control board is further configured to control the rotational velocity of the cooling fan. If T is larger than T0, the rotational velocity of the cooling fan is controlled to be the fourth rotational velocity when the linear compressor runs within predetermined time. If T is smaller than or equal to T0, the rotational velocity of the cooling fan is controlled to be the fifth rotational velocity when the linear compressor runs within predetermined time. The fifth rotational velocity is smaller than the fourth rotational velocity.

The main control board is further configured to monitor an operation status of the linear compressor. When the operation status of the linear compressor becomes abnormal, it is decreased by a preset value from the current rotational velocity of the cooling fan. After the operation status of the linear compressor becomes normal, the value of the fifth rotational velocity is updated with the current rotational velocity of the cooling fan.

In a specific embodiment of this invention, a preset environment temperature threshold T0 is 10° C., and a monitored environment temperature T is 0° C. which is lower than the preset environment temperature threshold 10° C. The rotational velocity of the cooling fan is controlled to be 2,800 r/min to increase the stroke of the piston in the linear compressor. At this moment, the operation condition of the refrigerator is the second operation condition. Thereafter, the operation status of the linear compressor is monitored. If the linear compressor runs abnormally, the rotational velocity of the cooling fan keeps decreasing by a preset value 100 r/min and the rotational velocity of the cooling fan is increased to 2,700 r/min.

Further, after the rotational velocity of the cooling fan is decreased to 2,700 r/min, the operation status of the linear compressor keeps being monitored. If the linear compressor runs abnormally, the rotational velocity of the cooling fan keeps decreasing by a preset value 100 r/min until the linear compressor runs normally. In this embodiment, after the linear compressor runs normally, the rotational velocity of the cooling fan is 2,500 r/min. At this moment, the operation condition of the refrigerator is the third operation condition and a preset value of the fifth rotational velocity is updated to a current rotational velocity of a cooling fan (2,500 r/min) in the meantime. Thereafter, if the environment temperature is lower than 10° C., the rotational velocity of the cooling fan is directly controlled to be 2500 r/min when the linear compressor runs within predetermined time. The process of controlling the rotational velocity of the cooling fan is a dynamic cycle. When the linear compressor starts up at a low temperature, there is no need for the cooling fan to decrease by a preset value from the preset fourth rotational velocity each time.

A refrigerator controlling method using a linear compressor according to the eighth embodiment of this invention is depicted as follows. The refrigerator in this embodiment is an air-cooling refrigerator or a direct cooling refrigerator. The refrigeration loop comprises an evaporator, a condenser, etc. A cooling fan is provided at the side of the condenser for heat radiation of the condenser. The controlling method comprises: monitoring an environment temperature T of the refrigerator located in the environment; comparing the environment temperature T with a preset environment temperature threshold T0; if T is larger than T0, controlling the rotational velocity of the cooling fan to a fourth rotational velocity; and if T is smaller than or equal to T0, controlling the rotational velocity of the cooling fan to be a fifth rotational velocity when the linear compressor runs within predetermined time. The fifth rotational velocity is smaller than the fourth rotational velocity.

Figure 11:
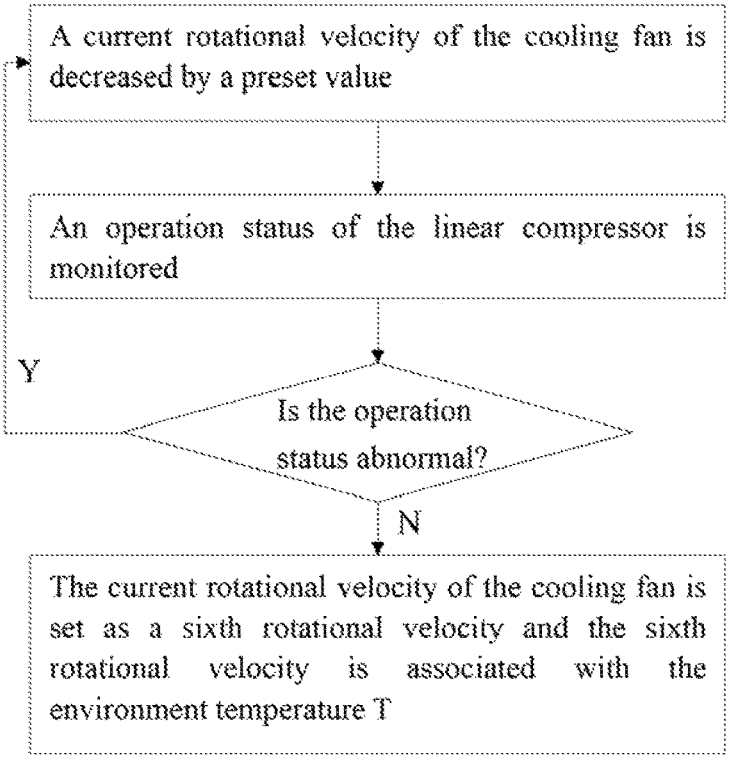
FIG. 11 is a detailed flow chart illustrating a refrigerator controlling method according to an eighth embodiment of this invention.

The foregoing steps are the same as those in the sixth embodiment. Further, as shown in FIG. 11, in this embodiment, it further comprises: monitoring an operation status of the linear compressor; when the operation status of the linear compressor becomes abnormal, decreasing by a preset value from the current rotational velocity of the cooling fan; and after the operation status of the linear compressor becomes normal, setting the current rotational velocity of the cooling fan as a sixth rotational velocity, associating the sixth rotational velocity with the environment temperature T, and controlling the rotational velocity of the cooling fan to be the sixth rotational velocity when the environment temperature is smaller than or equal to T.

Monitoring the operation status of the linear compressor comprises: determining whether the linear compressor stops unexpectedly during its running within the predetermined time; and if yes, taking the operation status of the linear compressor as abnormal.

Accordingly, in this embodiment, there is also provided a refrigerator controlling system using a linear compressor. The system comprises a temperature monitoring device and a main control board connected with the temperature monitoring device.

The temperature monitoring device is configured to monitor an environment temperature T of the refrigerator located in the environment.

The main control board is configured to compare the environment temperature T with a preset environment temperature threshold T0.

The main control board is further configured to control the rotational velocity of the cooling fan. If T is larger than T0, the rotational velocity of the cooling fan is controlled to be a fourth rotational velocity when the linear compressor runs within predetermined time. If T is smaller than or equal to T0, the rotational velocity of the cooling fan is controlled to be a fifth rotational velocity when the linear compressor runs within predetermined time. The fifth rotational velocity is smaller than the fourth rotational velocity.

The main control board is further configured to monitor an operation status of the linear compressor. When the operation status of the linear compressor becomes abnormal, it is decreased by a preset value from the current rotational velocity of the cooling fan. After the operation status of the linear compressor becomes normal, the current rotational velocity of the cooling fan is set as the sixth rotational velocity, the sixth rotational velocity is associated with the environment temperature T, and the rotational velocity of the cooling fan is controlled to be the sixth rotational velocity when the environment temperature is smaller than or equal to T.

In a specific embodiment of this invention, a preset environment temperature threshold T0 is 10° C., and a monitored environment temperature T is 0° C. which is lower than the preset environment temperature threshold 10° C. The rotational velocity of the cooling fan is controlled to be 2,800 r/min. At this moment, the operation condition of the refrigerator is the second operation condition to increase the stroke of the piston in the linear compressor. Thereafter, the operation status of the linear compressor is monitored. If the linear compressor runs abnormally, the rotational velocity of the cooling fan keeps decreasing by a preset value 100 r/min and the rotational velocity of the cooling fan is decreased to 2,700 r/min.

Further, after the rotational velocity of the cooling fan is decreased to 2,700 r/min, the operation status of the linear compressor keeps being monitored. If the linear compressor runs abnormally, the rotational velocity of the cooling fan keeps decreasing by a preset value 100 r/min until the linear compressor runs normally. Furthermore, the current rotational velocity of the cooling fan is associated with the current environment temperature.

Specifically, in this embodiment, after the linear compressor runs normally, the rotational velocity of the cooling fan is 2,500 r/min. At this moment, the operation condition of the refrigerator is the third operation condition, the current rotational velocity of the cooling fan (2,500 r/min) is set as the sixth rotational velocity of the refrigerating fan, and the sixth rotational velocity 2500 r/min is associated with the current environment temperature 0° C. During the next running of the refrigerator, if it is monitored that the environment temperature is smaller than or equal to 0° C., the rotational velocity of the cooling fan is directly controlled to be the sixth rotational velocity 2,500 r/min. If it is monitored that the environment temperature is 0° C.-10° C., the rotational velocity of the cooling fan is controlled by still following the method in the seventh embodiment.

In this embodiment, the process of controlling the rotational velocity of the cooling fan is a dynamic cycle. When the refrigerator starts up at a low temperature, there is no need for the cooling fan to decrease by a preset value from a preset rotational velocity each time.

Figure 12:
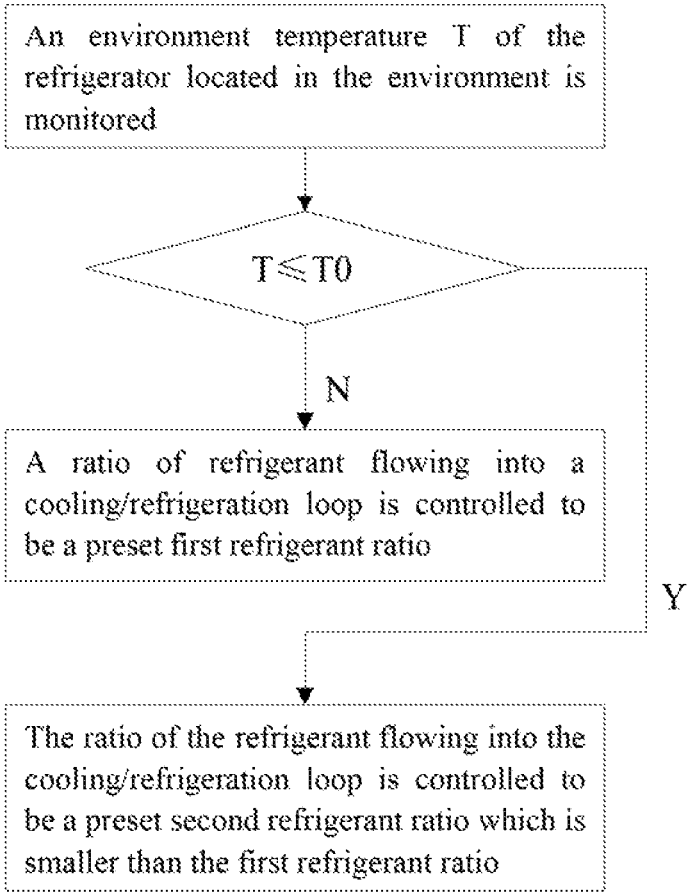
FIG. 12 is a detailed flow chart illustrating a refrigerator controlling method according to a ninth embodiment of this invention.

As shown in FIG. 12, a refrigerator controlling method using a linear compressor according to the ninth embodiment of this invention is depicted. The controlling method comprises: monitoring an environment temperature T of the refrigerator located in the environment; comparing the environment temperature T with a preset environment temperature threshold T0; if T is larger than T0, controlling a ratio of refrigerant flowing into a cooling/refrigeration loop to be a preset first refrigerant ratio; and if T is smaller than or equal to T0, controlling the ratio of the refrigerant flowing into the cooling/refrigeration loop to be a preset second refrigerant ratio. The second refrigerant ratio is smaller than the first refrigerant ratio. As such, the stroke of the piston in the linear compressor is increased when the linear compressor runs within predetermined time.

Accordingly, in this embodiment, there is also provided a refrigerator controlling system using a linear compressor. The system comprises: a temperature monitoring device and a main control board connected with the temperature monitoring device.

The temperature monitoring device is configured to monitor an environment temperature T of the refrigerator located in the environment.

The main control board is configured to compare the environment temperature T with a preset environment temperature threshold T0.

The main control board is further configured to control a ratio of refrigerant flowing into a cooling/refrigeration loop. If T is larger than T0, the ratio of the refrigerant flowing into the cooling/refrigeration loop is controlled to be a preset first refrigerant ratio. If T is smaller than or equal to T0, the ratio of the refrigerant flowing into the cooling/refrigeration loop is controlled to be a preset second refrigerant ratio. The second refrigerant ratio is smaller than the first refrigerant ratio. As such, the stroke of the piston in the linear compressor is increased when the linear compressor runs within predetermined time.

In this embodiment, if T is larger than T0, the ratio of the refrigerant flowing into the cooling/refrigeration loop is controlled to be a preset first refrigerant ratio A1. If T is smaller than or equal to T0, the ratio of the refrigerant flowing into the cooling/refrigeration loop is decreased and controlled to be a preset second refrigerant ratio A2, wherein A1>A2.

When the environment temperature T is lower than the preset environment temperature threshold T0, the heating load of the refrigerator is relatively low, and accordingly, the refrigeration amount required by compartments is relatively low. In a case where the refrigeration amount is rated, if the refrigeration loop still performs refrigerating in a normal condition, the piston stroke of the compressor will be decreased. In this embodiment, by decreasing the ratio of the refrigerant flowing into the cooling/refrigeration loop, the stroke of the piston in the linear compressor is increased. Thus, it prevents collision between the piston and the exhaust valve plate, and the frequency conversion plate will not launch the frequency conversion protection program, so that the refrigerator can run normally.

Optionally, in this embodiment, the total amount of the refrigerant remains unchanged. For refrigerant respectively flowing into a cooling/refrigeration loop and a freezing/refrigeration loop, when the ratio of the refrigerant flowing into the cooling/refrigeration loop is decreased, the ratio of the refrigerant flowing into the freezing/refrigeration loop will be increased accordingly. In addition, the increased refrigerant ratio of the freezing/refrigeration loop is equal to the decreased refrigerant ratio of the cooling/refrigeration loop. If T is larger than T0, the ratio of the refrigerant flowing into the freezing/refrigeration loop is a preset third refrigerant ratio A3. If T is smaller than or equal to T0, the ratio of the refrigerant flowing into the freezing/refrigeration loop is a preset fourth refrigerant ratio A4. The fourth refrigerant ratio A4 is larger than the third refrigerant ratio A. Furthermore, a difference between the first refrigerant ratio and the second refrigerant ratio is equal to a difference between the fourth refrigerant ratio and the third refrigerant ratio. That is, A1−A2=A4−A3.

Certainly, in other embodiments, it may only decrease the ratio of the refrigerant flowing into the cooling/refrigeration loop while the refrigerant ratio of the freezing loop remains unchanged. Or it may decrease the refrigerant ratio of the cooling/refrigeration loop and that of the freezing/refrigeration loop at the same time. As such, the total amount of the refrigerant in the whole refrigeration loop will be decreased, thereby further controlling the consumption of the refrigerant.

In a specific embodiment of this invention, a preset environment temperature threshold T0 is 10° C. When the environment temperature T is higher than 10° C., the first refrigerant ratio A1 of the cooling/refrigeration loop is 80%, while the third refrigerant ratio A3 of the freezing/refrigeration loop is 20%. At this moment, the operation condition of the refrigerator is the first operation condition. If the monitored environment temperature T is 0° C. which is lower than the preset environment temperature threshold 10° C., the second refrigerant ratio A2 of the cooling/refrigeration loop is controlled to be a preset 70% and the fourth refrigerant ratio A4 of the freezing/refrigeration loop is controlled to be a preset 30%. As such, the stroke of the piston in the linear compressor can be increased. In this case, the operation condition of the refrigerator is the second operation condition.

A refrigerator controlling method using a linear compressor according to a tenth embodiment of this invention is depicted as follows. The controlling method comprises: monitoring an environment temperature T of the refrigerator located in the environment; comparing the environment temperature T with a preset environment temperature threshold T0; if T is larger than T0, controlling a ratio of refrigerant flowing into a cooling/refrigeration loop to be a preset first refrigerant ratio; and if T is smaller than or equal to T0, controlling the ratio of the refrigerant flowing into the cooling/refrigeration loop to be a preset second refrigerant ratio. The second refrigerant ratio is smaller than the first refrigerant ratio. As such, the stroke of the piston in the linear compressor is increased when the linear compressor runs within predetermined time.

Figure 13:
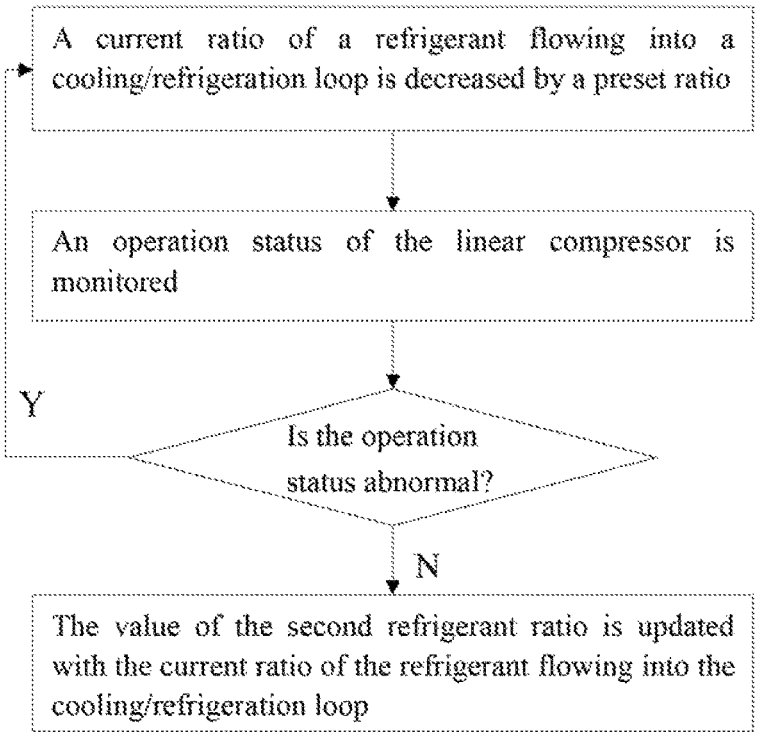
FIG. 13 is a detailed flow chart illustrating a refrigerator controlling method according to a tenth embodiment of this invention.

The foregoing steps are the same as those in the ninth embodiment. Further, as shown in FIG. 13, in this embodiment, it further comprises: monitoring an operation status of the linear compressor; when the operation status of the linear compressor becomes abnormal, decreasing by a preset ratio from a current ratio of refrigerant flowing into a cooling/refrigeration loop; and after the operation status of the linear compressor becomes normal, updating the value of the second refrigerant ratio with the current ratio of the refrigerant flowing into the cooling/refrigeration loop.

Monitoring the operation status of the linear compressor comprises: determining whether the linear compressor stops unexpectedly during its running within the predetermined time; and if yes, taking the operation status of the linear compressor as abnormal.

Accordingly, in this embodiment, there is also provided a refrigerator controlling system using a linear compressor. The system comprises a temperature monitoring device and a main control board connected with the temperature monitoring device.

The temperature monitoring device is configured to monitor an environment temperature T of the refrigerator located in the environment.

The main control board is configured to compare the environment temperature T with a preset environment temperature threshold T0.

The main control board is further configured to control a ratio of refrigerant flowing into a cooling/refrigeration loop. If T is larger than T0, the ratio of the refrigerant flowing into the cooling/refrigeration loop is controlled to be a preset first refrigerant ratio. If T is smaller than or equal to T0, the ratio of the refrigerant flowing into the cooling/refrigeration loop is controlled to be a preset second refrigerant ratio. The second refrigerant ratio is smaller than the first refrigerant ratio. As such, the stroke of the piston in the linear compressor is increased when the linear compressor runs within predetermined time.

The main control board is further configured to monitor an operation status of the linear compressor. When the operation status of the linear compressor becomes abnormal, it is decreased by a preset value from the current refrigerant ratio of the cooling/refrigeration loop. After the operation status of the linear compressor becomes normal, the value of the second refrigerant ratio is updated with the current refrigerant ratio of the cooling/refrigeration loop.

In a specific embodiment of this invention, the preset environment temperature threshold T0 is 10° C. and the monitored environment temperature T is 0° C. which is lower than the preset environment temperature threshold 10° C. The second refrigerant ratio A2 of the cooling/refrigeration loop is controlled to be 70% and the fourth refrigerant ratio A4 of the freezing/refrigeration loop is controlled to be 30%, so as to increase the stroke of the piston in the linear compressor. At this moment, the operation condition of the refrigerator is the second operation condition. Thereafter, the operation status of the linear compressor is monitored. If the linear compressor runs abnormally, the refrigerant flowing into the cooling/refrigeration loop keeps decreasing by a preset ratio 10%, while the second refrigerant ratio A2 of the cooling/refrigeration loop is 60%.

Further, after the ratio of the refrigerant flowing into the cooling/refrigeration loop is decreased to 60%, the operation status of the linear compressor keeps being monitored. If the linear compressor runs abnormally, the ratio of the refrigerant flowing into the cooling/refrigeration loop keeps decreasing by a preset ratio 10% until the linear compressor runs normally. In this embodiment, after the linear compressor runs normally, the ratio of the refrigerant flowing into the cooling/refrigeration loop is 50%. In the meantime, the preset value of the second refrigerant ratio is updated to the current refrigerant ratio (50%) of the cooling/refrigeration loop. Thereafter, if the environment temperature is lower than 10° C., the ratio of the refrigerant flowing into the cooling/refrigeration loop is directly controlled to be 50% during the next running of the compressor. The process of controlling the ratio of the refrigerant flowing into the cooling/refrigeration loop is a dynamic cycle. When the linear compressor starts up at a low temperature, there is no need for the linear compressor to decrease by a preset ratio from the preset second refrigerant ratio each time.

A refrigerator controlling method using a linear compressor according to the eleventh embodiment of this invention is depicted as follows. The controlling method comprises: monitoring an environment temperature T of the refrigerator located in the environment; comparing the environment temperature T with a preset environment temperature threshold T0; if T is larger than T0, controlling a ratio of refrigerant flowing into a cooling/refrigeration loop to be a preset first refrigerant ratio; and if T is smaller than or equal to T0, controlling the ratio of the refrigerant flowing into the cooling/refrigeration loop to be a preset second refrigerant ratio. The second refrigerant ratio is smaller than the first refrigerant ratio. As such, the stroke of the piston in the linear compressor is increased when the linear compressor runs within predetermined time.

Figure 14:
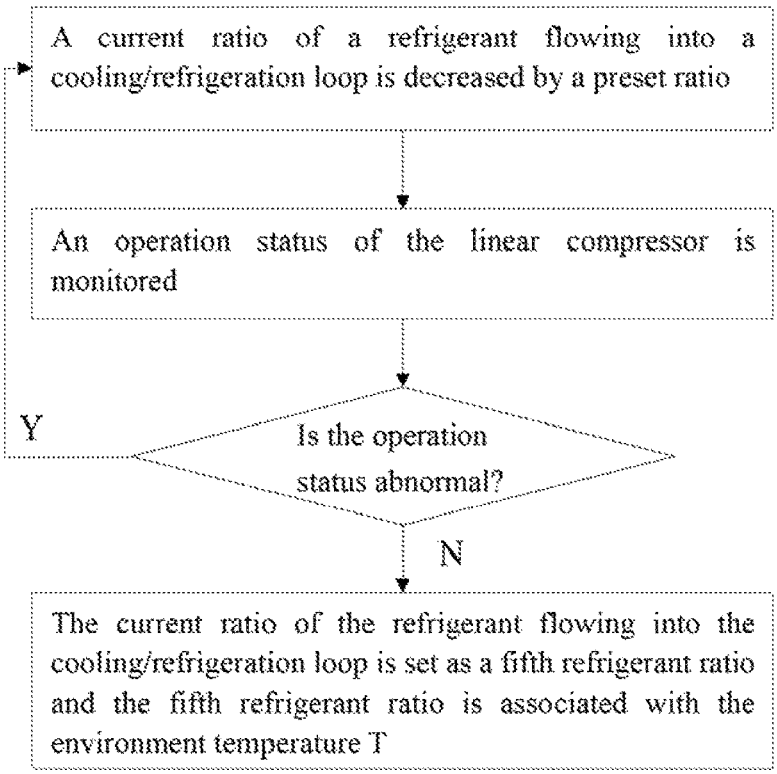
FIG. 14 is a detailed flow chart illustrating a refrigerator controlling method according to an eleventh embodiment of this invention.

The foregoing steps are the same as those in the ninth embodiment. Further, as shown in FIG. 14, in this embodiment, it further comprises: monitoring an operation status of the linear compressor; when the operation status of the linear compressor becomes abnormal, decreasing by a preset ratio from the current ratio of the refrigerant flowing into the cooling/refrigeration loop; and when the operation status of the linear compressor becomes normal, setting the current ratio of the refrigerant flowing into the cooling/refrigeration loop as a fifth refrigerant ratio, associating the fifth refrigerant ratio with the environment temperature T, and controlling a flow direction of the refrigerant with the fifth refrigerant ratio when the environment temperature is smaller than or equal to T.

Accordingly, in this embodiment, there is also provided a refrigerator controlling system using a linear compressor. The system comprises a temperature monitoring device and a main control board connected with the temperature monitoring device.

The temperature monitoring device is configured to monitor an environment temperature T of the refrigerator located in the environment.

The main control board is configured to compare the environment temperature T with a preset environment temperature threshold T0.

The main control board is further configured to control a ratio of refrigerant flowing into a cooling/refrigeration loop. If T is larger than T0, the ratio of the refrigerant flowing into the cooling/refrigeration loop is controlled to be a preset first refrigerant ratio. If T is smaller than or equal to T0, the ratio of the refrigerant flowing into the cooling/refrigeration loop is controlled to be a preset second refrigerant ratio. The second refrigerant ratio is smaller than the first refrigerant ratio. As such, the stroke of the piston in the linear compressor is increased when the linear compressor runs within predetermined time.

The main control board is further configured to monitor the operation status of the linear compressor. When the operation status of the linear compressor becomes abnormal, it is decreased by a preset ratio from a current ratio of refrigerant flowing into a cooling/refrigeration loop. When the operation status of the linear compressor becomes normal, the current ratio of the refrigerant flowing into the cooling/refrigeration loop is set as a fifth refrigerant ratio, the fifth refrigerant ratio is associated with the environment temperature T, and a flow direction of the refrigerant is controlled with the fifth refrigerant ratio when the environment temperature is smaller than or equal to T.

In a specific embodiment of this invention, a preset environment temperature threshold T0 is 10° C., and a monitored environment temperature T is 0° C. which is lower than the preset environment temperature threshold 10° C. The second refrigerant ratio A2 of a cooling/refrigeration loop is controlled to be 70% and the fourth refrigerant ratio A4 of a freezing/refrigeration loop is controlled to be 30% so as to increase the stroke of the piston in the linear compressor. At this moment, the operation condition of the refrigerator is the second operation condition. Thereafter, the operation status of the linear compressor is monitored. If the linear compressor runs abnormally, the refrigerant flowing into the cooling/refrigeration loop keeps decreasing by a preset ratio 10%, so the ratio of the refrigerant flowing into the cooling/refrigeration loop becomes 60%.

Further, after the ratio of the refrigerant flowing into the cooling/refrigeration loop is decreased to 60%, the operation status of the linear compressor keeps being monitored. If the linear compressor runs abnormally, the ratio of the refrigerant flowing into the cooling/refrigeration loop keeps decreasing by a preset ratio 10% until the linear compressor runs normally. In this embodiment, after the linear compressor runs normally, the ratio of the refrigerant flowing into the cooling/refrigeration loop is 50%. At this moment, the operation condition of the refrigerator is the second operation condition. The current ratio of the refrigerant flowing into the cooling/refrigeration loop is set as a fifth refrigerant ratio A5 and the current environment temperature T is associated with the fifth refrigerant ratio A5.

Specifically, the fifth refrigerant ratio 50% is set as an initial value of a refrigerant distribution ratio when the environment temperature is smaller than or equal to the current environment temperature 0° C. Thereafter, if it is monitored that the environment temperature is lower than 0° C., the ratio of the refrigerant flowing into the cooling/refrigeration loop is directly controlled to be 50% during the next running of the compressor. If it is monitored that the environment temperature is 0° C.-10° C., the ratio of the refrigerant flowing into the cooling/refrigeration loop is controlled by still following the method in the second embodiment.

In this embodiment, the process of controlling the ratio of the refrigerant flowing into the cooling/refrigeration loop is a dynamic cycle. There is no need for the linear compressor to decrease by a preset ratio from a preset refrigerant ratio each time when the linear compressor starts up at a low temperature.

In this invention, controlling the operation condition of the linear compressor includes but not limited to controlling the heating device, the rotational velocity of the refrigerating fan, the rotational velocity of the cooling fan and the ratio of the refrigerant flowing into the cooling/refrigeration loop in the foregoing embodiments. Other embodiment manners of changing the operation condition of the linear compressor by means of a refrigerating unit and/or a heating unit also fall within the protection scope of this invention.

As can be seen from the foregoing technical solutions, according to this invention, the operation condition of the linear compressor is controlled by means of the refrigerating unit and/or the heating unit in the refrigerator so as to increase the stroke of the piston in the linear compressor, thereby preventing the refrigerator from not running normally due to protection of a frequency conversion plate to the linear compressor.

It should be understood that, although the specification is described in accordance with embodiments, not every embodiment only contains a separate technical solution. The description manner in the specification is just for the sake of clarity. Those skilled in the art should take the specification as a whole. The technical solution in each embodiment can also be combined to form other embodiments which those skilled in the art can understand.

The above detailed description is only specific for the feasible embodiments of the present application. They are not used to limit the protection scope of the present application. Any equivalent embodiment or modification made without breaking away from the spirit of the application shall fall within the protection scope of the present application.

What is claimed is:

1. A refrigerator controlling method with a linear compressor, the method comprising:

monitoring an environment temperature T of the refrigerator located in the environment;

comparing the environment temperature T with a preset environment temperature threshold T0;

if T is larger than T0, controlling a refrigerating unit and/or a heating unit in the refrigerator such that the refrigerator runs under a first operation condition; and if T is smaller than or equal to T0, controlling the refrigerating unit and/or the heating unit in the refrigerator such that the refrigerator runs under a second operation condition;

wherein, when the linear compressor runs within predetermined time, controlling a refrigeration amount of the linear compressor under the second operation condition to be larger than a refrigeration amount of the linear compressor under the first operation condition, such that a compartment of the refrigerator reaches a target temperature;

wherein controlling the refrigeration amount of the linear compressor under the second operation condition to be larger than the refrigeration amount of the linear compressor under the first operation condition comprises:

in a case where a refrigerator load does not vary, controlling a refrigeration amount required by a freezing compartment of the refrigerator under the second operation condition to be larger than a refrigeration amount required by the freezing compartment of the refrigerator under the first operation condition.

2. The method of claim 1, further comprising:

monitoring an operation status of the linear compressor;

when the operation status of the linear compressor becomes abnormal, changing the operation condition of the refrigerator so as to increase the refrigeration amount required by the freezing compartment of the refrigerator when the linear compressor runs within the predetermined time; and after the operation status of the linear compressor becomes normal, setting a current operation condition of the refrigerator as the second operation condition.

3. The method of claim 1, further comprising:

monitoring an operation status of the linear compressor;

when the operation status of the linear compressor becomes abnormal, changing the operation condition of the refrigerator so as to increase the refrigeration amount required by the freezing compartment of the refrigerator when the linear compressor runs within the predetermined time; and after the operation status of the linear compressor becomes normal, setting a current operation condition of the refrigerator as a third operation condition, associating the third operation condition with the environment temperature T, and controlling the refrigerator to run under the third operation condition when the environment temperature is smaller than or equal to T.

4. The method of claim 1, wherein controlling the refrigeration amount of the linear compressor under the second operation condition to be larger than the refrigeration amount of the linear compressor under the first operation condition comprises:

in a case where a refrigerator load does not vary, controlling a refrigeration amount per unit volume of a refrigerant in a freezing loop of the refrigerator under the second operation condition to be larger than a refrigeration amount per unit volume of the refrigerant in the freezing loop of the refrigerator under the first operation condition.

5. The method of claim 4, further comprising:

monitoring an operation status of the linear compressor;

when the operation status of the linear compressor becomes abnormal, changing the operation condition of the refrigerator so as to increase the refrigeration amount per unit volume of the refrigerant in the freezing loop of the refrigerator; and after the operation status of the linear compressor becomes normal, setting a current operation condition of the refrigerator as the second operation condition.

6. The method of claim 4, further comprising:

monitoring an operation status of the linear compressor;

when the operation status of the linear compressor becomes abnormal, changing the operation condition of the refrigerator so as to increase the refrigeration amount per unit volume of a refrigerant in the freezing loop of the refrigerator; and after the operation status of the linear compressor becomes normal, setting a current operation condition of the refrigerator as a third operation condition, associating the third operation condition with the environment temperature T, and controlling the refrigerator to run under the third operation condition when the environment temperature is smaller than or equal to T.

7. The method of claim 2, wherein monitoring the operation status of the linear compressor comprises:

determining whether the linear compressor stops unexpectedly during its running within the predetermined time; and if yes, taking the operation status of the linear compressor as abnormal.

8. A refrigerator controlling system with a linear compressor, the system comprising a temperature monitoring device and a main control board connected with the temperature monitoring device; wherein the temperature monitoring device is configured to monitor an environment temperature T of the refrigerator located in the environment;

the main control board is configured to compare the environment temperature T with a preset environment temperature threshold T0; and the main control board is further configured to control a refrigerating unit and/or a heating unit in the refrigerator in such a way that, when T is larger than T0, the main control board controls the refrigerating unit and/or the heating unit in the refrigerator such that the refrigerator runs under a first operation condition, and when T is smaller than or equal to T0, the main control board controls the refrigerating unit and/or the heating unit in the refrigerator such that the refrigerator runs under a second operation condition;

wherein, when the linear compressor runs within predetermined time, a refrigeration amount of the linear compressor under the second operation condition is controlled to be larger than a refrigeration amount of the linear compressor under the first operation condition, such that a compartment of the refrigerator reaches a target temperature;

wherein the main control board is further configured to:

in a case where a refrigerator load does not vary, control a refrigeration amount required by a freezing compartment of the refrigerator under the second operation condition to be larger than a refrigeration amount required by the freezing compartment of the refrigerator under the first operation condition.

9. The system of claim 8, wherein the main control board is further configured to:

monitor an operation status of the linear compressor;

when the operation status of the linear compressor becomes abnormal, change the operation condition of the refrigerator so as to increase the refrigeration amount required by the freezing compartment of the refrigerator when the linear compressor runs within the predetermined time; and after the operation status of the linear compressor becomes normal, set a current operation condition of the refrigerator as the second operation condition.

10. The system of claim 8, wherein the main control board is further configured to:

monitor an operation status of the linear compressor;

when the operation status of the linear compressor becomes abnormal, change the operation condition of the refrigerator so as to increase the refrigeration amount required by the freezing compartment of the refrigerator when the linear compressor runs within the predetermined time; and after the operation status of the linear compressor becomes normal, set a current operation condition of the refrigerator as a third operation condition, associate the third operation condition with the environment temperature T, and control the refrigerator to run under the third operation condition when the environment temperature is smaller than or equal to T.

11. The system of claim 8, wherein the main control board is further configured to:

in a case where a refrigerator load does not vary, control a refrigeration amount per unit volume of a refrigerant in a freezing loop of the refrigerator under the second operation condition to be larger than a refrigeration amount per unit volume of the refrigerant in the freezing loop of the refrigerator under the first operation condition.

12. The system of claim 11, wherein the main control board is further configured to:

monitor an operation status of the linear compressor;

when the operation status of the linear compressor becomes abnormal, change the operation condition of the refrigerator so as to increase the refrigeration amount per unit volume of the refrigerant in the freezing loop of the refrigerator; and after the operation status of the linear compressor becomes normal, set a current operation condition of the refrigerator as the second operation condition.

13. The system of claim 11, wherein the main control board is further configured to:

monitor an operation status of the linear compressor;

when the operation status of the linear compressor becomes abnormal, change the operation condition of the refrigerator so as to increase the refrigeration amount per unit volume of the refrigerant in the freezing loop of the refrigerator; and after the operation status of the linear compressor becomes normal, set a current operation condition of the refrigerator as a third operation condition, associate the third operation condition with the environment temperature T, and control the refrigerator to run under the third operation condition when the environment temperature is smaller than or equal to T.

14. The system of claim 9, wherein the main control board is further configured to:

determine whether the linear compressor stops unexpectedly during its running within the predetermined time; and if yes, take the operation status of the linear compressor as abnormal.

15. The system of claim 10, wherein the main control board is further configured to:

determine whether the linear compressor stops unexpectedly during its running within the predetermined time; and if yes, take the operation status of the linear compressor as abnormal.

16. The system of claim 12, wherein the main control board is further configured to:

determine whether the linear compressor stops unexpectedly during its running within the predetermined time; and if yes, take the operation status of the linear compressor as abnormal.

17. The system of claim 13, wherein the main control board is further configured to:

determine whether the linear compressor stops unexpectedly during its running within the predetermined time; and if yes, take the operation status of the linear compressor as abnormal.

* * * * *